US006032595A

United States Patent [19]

Okuyama

[11] Patent Number: 6,032,595

[45] Date of Patent: Mar. 7, 2000

[54] ELECTRONICALLY CONTROLLED SEWING MACHINE HAVING ANIMATION INFORMATION DISPLAY SYSTEM

[75] Inventor: Tsuneo Okuyama, Inabe-gun, Japan

[73] Assignee: Brother Kogyo Kabushiki Kaisha, Nagoya, Japan

[21] Appl. No.: 09/140,002

[22] Filed: Aug. 26, 1998

[30] Foreign Application Priority Data

Aug. 27, 1997 [JP] Japan ..... 9-247887

[51] Int. Cl.[7] ..... D05B 21/00

[52] U.S. Cl. ..... 112/102.5; 112/445; 112/475.19; 345/473

[58] Field of Search ..... 112/470.01, 470.06, 112/102.5, 277, 445; 364/470.09, 470.07; 345/473; 340/815.4, 815.83

[56] References Cited

U.S. PATENT DOCUMENTS 4,301,753 11/1981 Meier ..... 112/445 X
4,901,656 2/1990 Yoshida ..... 112/445 X
5,782,189 7/1998 Hirata ..... 112/445 X
5,791,270 8/1998 Morita ..... 112/445 X

*Primary Examiner*—Peter Nerbun
*Attorney, Agent, or Firm*—Oliff & Berridge, PLC

[57] ABSTRACT

An electronically controlled sewing machine has a liquid crystal display as well as a needle bar rocking mechanism for driving a needle bar to which a needle is attached, a thread take-up lever driving mechanism, a needle thread catcher and so on. One of three kinds of animation information stored in a message memory of the sewing machine is selectively read in, and is presented on the display according to an error message display control or a guide message display control when any error/guide message appears on the display. Therefore, even when an operator sees the display with less attention, the presented animation information attracts the operator to the display when any error/guide message appears on the display, resulting in that the operator will not miss the displayed important error/guide message.

16 Claims, 7 Drawing Sheets

ELECTRONICALLY CONTROLLED SEWING MACHINE HAVING ANIMATION INFORMATION DISPLAY SYSTEM

CROSS REFERENCE TO RELATED APPLICATION

This application relates to and incorporates herein by reference Japanese Patent Application No. Hei. 9-247887 filed on Aug. 27, 1997.

BACKGROUND OF THE INVENTION

1. Field of the Invention

The present invention relates to a sewing machine having a sewing unit and a display unit, and more particularly to an improved display unit which attracts an operator to a display by displaying an animation information in association with displaying various error or guide messages on the display during operation of a sewing machine.

2. Related Art

A conventional sewing machine has a stitching unit for stitching on a workpiece (cloth), an embroidery unit, a liquid crystal display and a control panel. The stitching unit has a sewing needle movable in a vertical direction and a needle thread catcher for stitching in cooperation with the needle. The embroidery unit drives an embroidery frame on which the workpiece is removably mounted, to move in two directions perpendicular to each other independently. On the display, not only selectable various embroidery patterns to be embroidered, but also various messages and information are presented.

JP-A-1-129877 discloses an information display unit for a sewing machine. The sewing machine has a liquid crystal display and a control unit having a ROM, in which utility stitch pattern display data, general usage information display data (e.g., information on how to set a thread to the sewing machine), stitch information display data (e.g., buttonhole hemstitch, zigzag stitch) and error information warning display data are stored. The information display unit reads in these data so that the data appear on the display as the need arises. However, as each information is displayed as a static image, the static image is generally not so conspicuous and does not necessarily attract the operator. Therefore, the operator may not pay attention to the display during operation of the sewing machine, resulting in that the operator may miss a message appearing on the display, even if the message is an error message which is very important and indispensable for the operation of the sewing machine.

JP-A-4-221595 discloses an automatic multi-pattern embroidery sewing machine having a display on which various stitch patterns appear. In the sewing machine, several combinations of a series of formation patterns relating to objects such as bird, wind or moon are memorized. A desired combination of the formation patterns is selected by a pattern select switch and collectively shown on the display to be embroidered on a workpiece. However, these patterns are also static images having little impact, and do not necessarily attract the operator to the display either.

JP-A-5-127948 discloses a monitoring unit for a sewing machine. If an error occurs to any monitored device, colored animation information corresponding to the kind of the error appears on a display of the sewing machine. Further, when an operator or a service engineer need help information about the error, the animation help information corresponding to the error appears on the display. However, colored animation information in a lot of frames need to be stored in the monitoring unit for error indication in one-to-one correspondence with various possible errors. Therefore, an animation information memory of the monitoring unit has to be large. Further, it takes several seconds to several tens of seconds, for example, to inform the operator that an error has occurred.

SUMMARY OF THE INVENTION

It is an object of the present invention to provide a sewing machine having a display, which attracts an operator to the display when an error message or a guide message appears on the display so that the operator will not miss the error/guide message.

According to the present invention, a sewing machine has an animation information storing unit, a message display control unit and a display. The animation information storing unit stores at least one set of animation information in a plurality of frames representing a series of movement of a character. When a message appears on the display, the message display control unit displays an animation information sent from the animation information storing unit on the display. Therefore, even when an operator of the sewing machine sees the display with less attention, the animation information presented on the display attracts the operator, resulting in that the operator will not miss the displayed message. The animation information may be displayed before the message is displayed. Further, the animation information and the message may be displayed simultaneously.

Preferably, the animation information is displayed before the message appears on the display. The length of the animation information to attract the operator is set relatively short, decreasing the animation information volume to be stored. The message display control is simplified because the animation information and the message are displayed separately.

Preferably, the animation information storing unit stores a plurality of sets of different animation information therein so that a different animation information representing a different character is presented for each display of the message. The operator can thus enjoy each of the different characters of the animation information every time the message is displayed, and eventually enjoy sewing.

Further, the sets of the animation information are preferably presented on the display in a preset order or in a random order so that the operator can expect the next character of the animation information presented on the display. Thus, not only a mother, as an operator, but also her child can get interested in the sewing machine.

BRIEF DESCRIPTION OF THE DRAWINGS

Additional objects and advantages of the present invention will be more readily apparent from the following detailed description of a preferred embodiment when taken together with the accompanying drawings, in which.

DETAILED DESCRIPTION OF THE PREFERRED EMBODIMENTS

The present invention is applied to an electronically controlled embroidery sewing machine having a removably mounted embroidery device by which various embroidery stitches can be sewn, for example.

Figure 1:
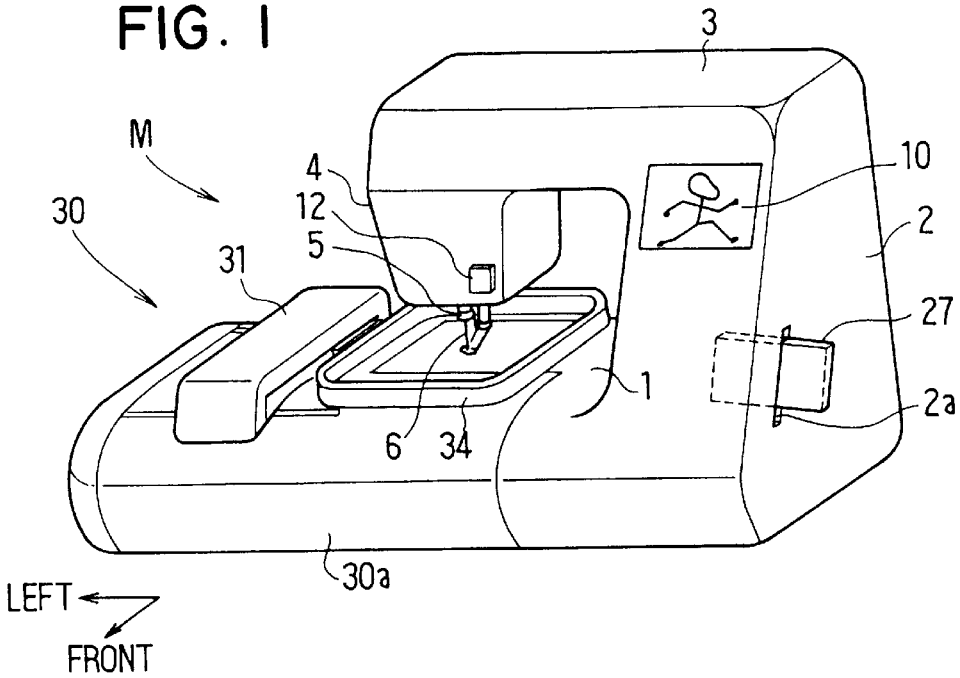
FIG. 1 is a schematic perspective view showing an electronically controlled embroidery sewing machine according to an embodiment of the present invention.

As shown in FIG. 1, an electronically controlled embroidery sewing machine M has a flat bed 1, a column 2 extending upwardly from a right end portion of the bed 1 and an arm 3 extending leftwardly from the top of the column 2 in parallel with the bed 1.

Figure 2:
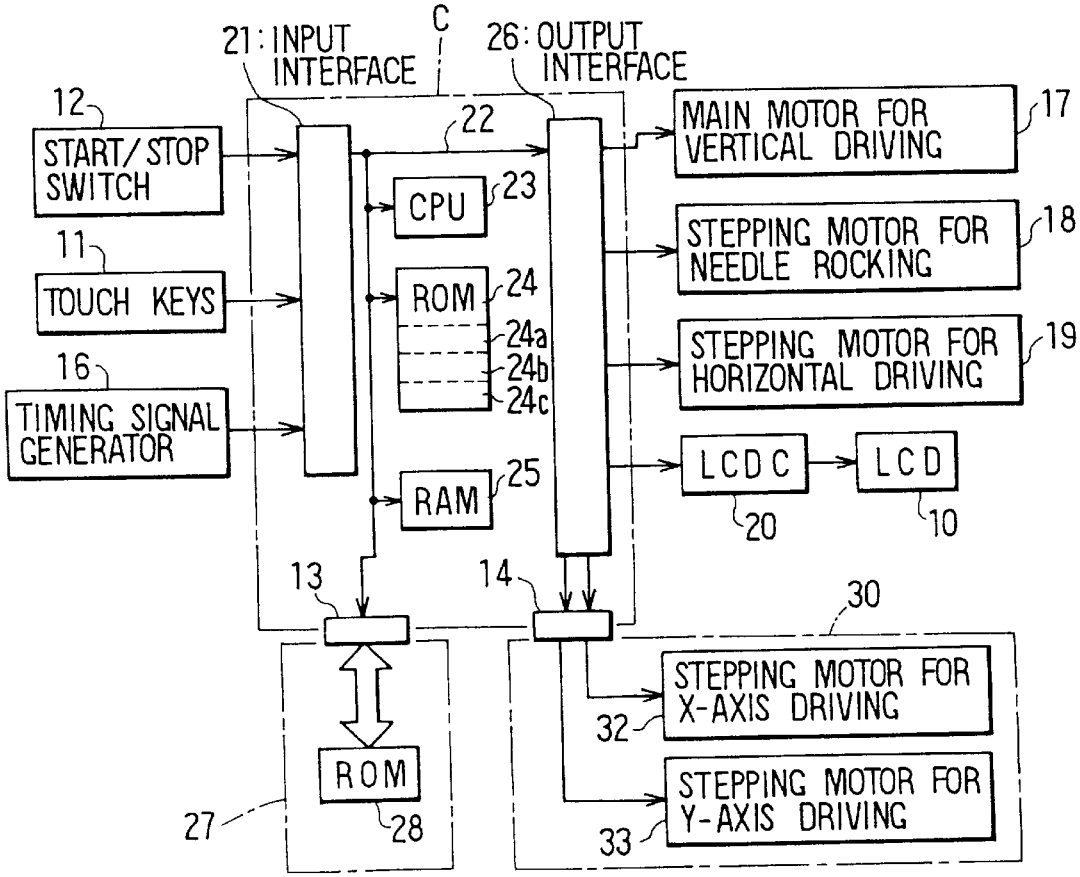
FIG. 2 is a block diagram of a control system of the embroidery sewing machine according to the embodiment.

The bed 1 is provided with a feed dog up/down moving mechanism (not shown) for moving a feed dog upwardly and downwardly, a feed dog back/forth moving mechanism (not shown) for moving a feed dog forwardly and backwardly and a needle thread catcher (e.g., horizontal type) which accommodates a bobbin and forms stitches in cooperation with a needle 6. The column 2 has a card slot 2*a*. A ROM card 27 storing many kinds of embroidery pattern data is optionally inserted into the card slot 2*a* to be connected with a card connector 13 (FIG. 2). The arm 3 has a needle bar driving mechanism for moving a needle bar 5 upwardly and downwardly, a needle bar rocking mechanism (not shown) for rocking the needle bar 5 in a direction perpendicular to a workpiece feeding direction and a thread take-up lever driving mechanism (not shown) for moving a thread take-up lever (not shown) upwardly and downwardly in a timed relationship with the up-and-down movement of the needle bar 5. The needle 6 is mounted on the lower end of the needle bar 5.

As shown in FIG. 2, the feed dog up/down moving mechanism, the needle bar driving mechanism and the thread take-up lever driving mechanism are driven by a sewing machine motor 17, the needle bar rocking mechanism is driven by a needle bar rocking stepping motor 18, and the feed dog back/forth moving mechanism is driven by a feed dog back/forth moving stepping motor 19.

Referring back to FIG. 1, an arm head 4 at the end of the arm 3 has a start/stop switch 12 for commanding the sewing machine M to start and stop sewing. A liquid crystal display 10 is attached to the front face of the arm 3. The display 10 shows various utility stitch/embroidery patterns, names of various functions and various error/guide messages. On the front face of the display 10, a plurality of touch keys 11 (FIG. 2) made of transparent electrodes are provided to be arranged in a matrix form, corresponding to each of the display positions of the embroidery patterns, the function names and so on. A desired embroidery pattern or function can be selected by pressing the touch key 11 corresponding to the desired embroidery pattern or function.

A free bed portion called free arm is formed at a left end portion of the bed 1. An embroidery unit 30 is removably mounted on the free bed portion. The embroidery unit 30 has a case 30*a*, an embroidery frame 34 on which a workpiece (cloth) is removably mounted and a frame case 31. The frame case 31 is integrated with a Y-direction driving mechanism for driving the embroidery frame 34 in the Y direction (i.e., back and forth direction). An X-direction driving mechanism is accommodated in the case 30*a*, for driving the frame case 31 including the Y-direction driving mechanism in the X-direction (i.e., left and right direction).

As shown in FIG. 2, the X-direction driving mechanism is driven by a first stepping motor 32, and the Y-direction driving mechanism is driven by a second stepping motor 33. When the embroidery unit 30 is mounted on the free bed portion, the first and second stepping motors 32, 33 are electrically connected to a control unit C of the sewing machine M through a connector 14. The first and second stepping motors 32, 33 are controlled by the control unit C so that the embroidery frame 34 and the workpiece W are driven to move in the X and Y directions independently for embroidery sewing.

The control unit C has an input interface 21, a computer having a CPU 23, a ROM 24 and a RAM 25, an output interface 26 and a bus 22 for connection between these components 21 and 23–26. The input interface 21 is connected with the start/stop switch 12, the touch keys 11 and a timing signal generator 16 for detecting several rotation phases of a main shaft of the sewing machine M. The output interface 26 is connected with the sewing machine motor 17, the needle bar rocking stepping motor 18, the feed dog back/forth driving stepping motor 19, a display controller 20 (LCDC) for the display 10 (LCD) and the first and second stepping motors 32, 33 for the embroidery unit 30. Further, a ROM 28 of the ROM card 27 is connectable to the bus 22 through the card connector 13.

A program memory 24*a* in the ROM 24 stores therein various control programs including a general control program for a general control such as utility stitch sewing/display control, a pattern select/edit/sewing control program and a display information control program. The pattern select/edit/sewing control program is applied to both an editing process in which a desired size and location of an embroidery is edited through the display 10 and an embroidery sewing process in which a selected embroidery pattern is embroidered on a workpiece.

Further, a data memory 24*b* in the ROM 24 stores display/sewing data regarding to several utility stitch patterns, and pattern data of embroidery patterns used relatively frequently. The pattern data are classified into several groups according to the kind of embroidery pattern, and each of the pattern data is given a pattern number. On the other hand, pattern data of embroidery patterns used relatively less frequently are stored in the ROM 28 in the ROM card 27. These pattern data are also classified into several groups according to the kind of the embroidery pattern, and each of the pattern data is given a pattern number, in the same manner as in the ROM 24.

Further, a message memory 24*c* in the ROM 24 stores several message dot image data for displaying various error messages and guide messages, and each of the message dot image data is given an error or guide number.

Figure 3:
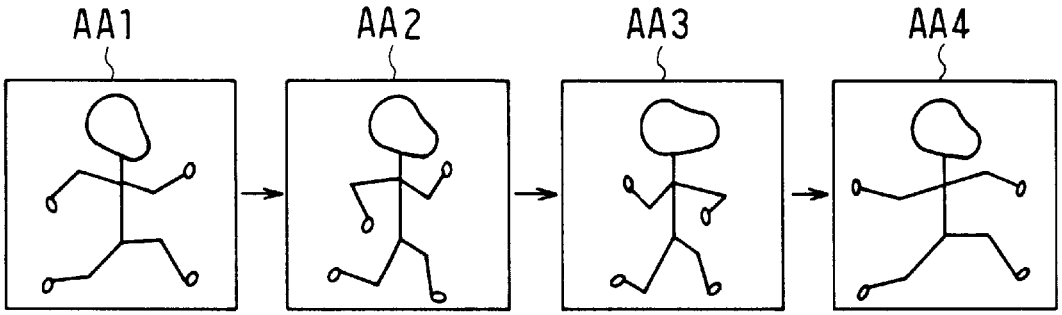
FIG. 3 is a schematic view showing a sequence of animation information in four frames representing a human being according to the embodiment.
Figure 4:
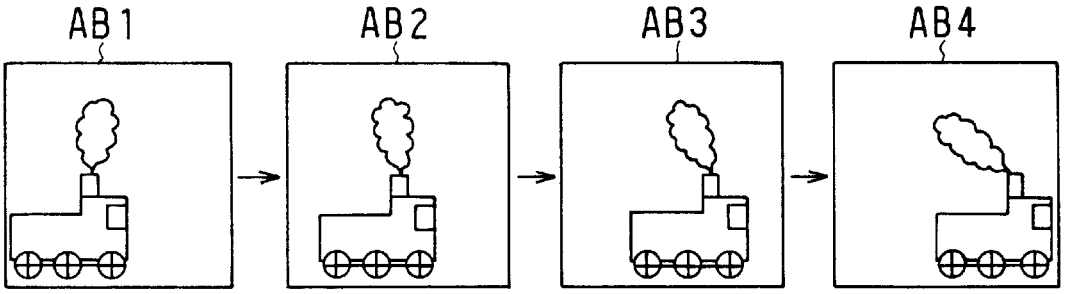
FIG. 4 is a schematic view showing a sequence of animation information in four frames representing a steam locomotive according to the embodiment.
Figure 5:
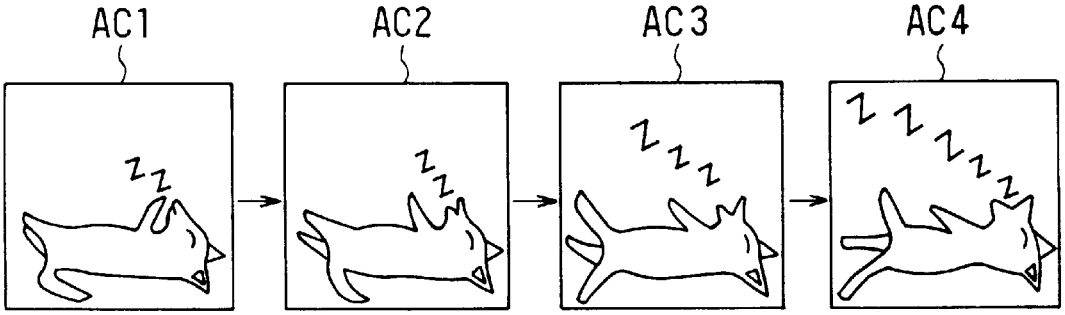
FIG. 5 is a schematic view showing a sequence of animation information in four frames representing a dog according to the embodiment.

Referring to FIGS. 3–5, the message memory 24*c*, which functions as an animation information memory unit, further stores three kinds of animation informations AA, AB and AC. As shown in FIG. 3, the animation information AA consists of four frames AA1–AA4 and represents a running human being. As shown in FIG. 4, the animation information AB consists of four frames AB1–AB4 and represents a steam locomotive running while puffing out smoke. As shown in FIG. 5, the animation information AC consists of four frames AC1–AC4 and represents a dog snoring in its sleep.

The RAM 25 is provided with memories such as flags, pointers, counters, registers and buffer, which are necessary for various controls.

Next, the information display control performed by the control unit C, particularly the CPU 23, will be described based on the programmed routine shown in FIG. 6. In the routine to follow, when the control unit C is activated, a SELECT MENU screen is displayed on the display 10 at step S10 to show embroidery pattern menus such as utility stitch pattern menu, letters/characters pattern menu and drawing pattern menu. A desired pattern menu is selected from the SELECT MENU screen by pressing the corresponding touch key 11 at step S11, and several embroidery patterns included in the selected pattern menu are presented on the display 10 at step S12, as a list arranged in a matrix form. Next, a desired embroidery pattern is selected from the selected pattern menu using the touch key 11 at step S13, and the selected embroidery pattern and several pattern portions constituting the embroidery pattern, classified by color, appear on the display 10 at step S14.

Figure 10:
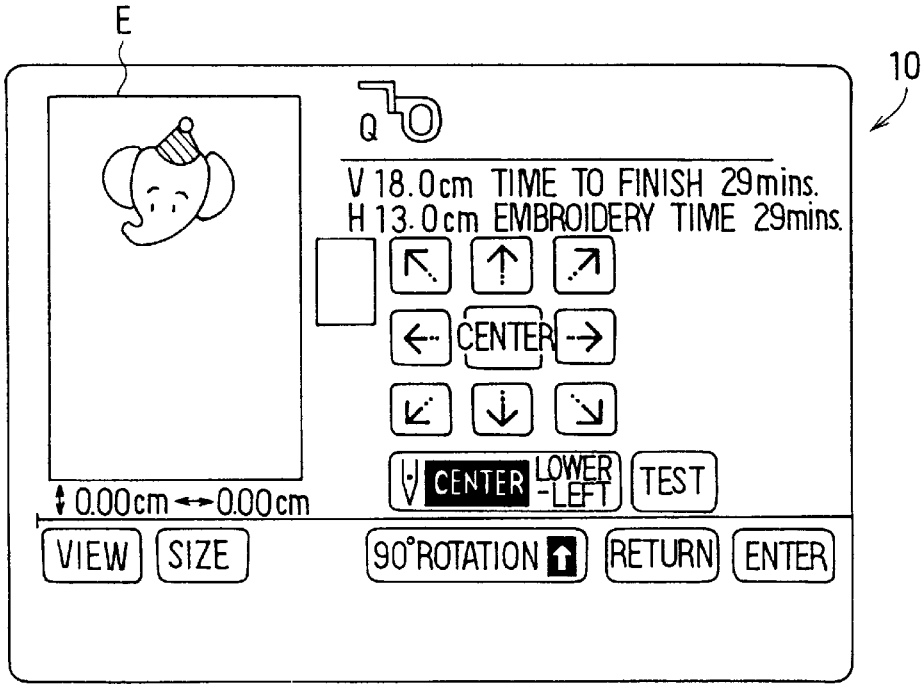
FIG. 10 is a schematic view showing an EDIT screen on a display of the embroidery sewing machine according to the embodiment.

Next, when an edit key (i.e., layout key) is pressed, an EDIT screen is displayed on the display 10 at step S15, as shown in FIG. 10. In the EDIT screen, an embroidery area E corresponding to the embroidery frame 34 with the selected embroidery pattern appearing therein and various function names and marks are displayed. The functions include eight-direction moving functions with an arrow mark for moving an embroidery location of the embroidery pattern in eight directions, a rotation function for rotating the direction of the embroidery pattern and a size change function for changing the size of the embroidery pattern. The embroidery location and the size of the embroidery pattern are edited by pressing the touch key 11 corresponding to the desired function at step S16. This edit process is a general one and may be performed by various disclosed edit processing methods.

Next, when a workpiece W is set to the embroidery frame 34, and it is determined that the start/stop switch 12 is set to START at step S17, an EMBROIDERY screen appears on the display 10 at step S18. During embroidery, the EMBROIDERY screen shows an entire embroidery time in which the entire embroidery pattern is embroidered, and a portion-classified-by-color embroidery time in which each of the pattern portions classified by color is embroidered. When it is determined that the embroidery is completed at step S19, the control sequence returns to step S10.

The control unit C is provided with an interval timer which outputs an interrupt signal at a cycle of 70 Hz. The animation display count interrupt process shown in FIG. 7 is performed whenever the interval timer outputs the interrupt signal. If it is determined that a counter value N of an animation display counter is not two-byte maximum value FFFF(H) at step S30 during the animation display count interrupt process, the counter value N is incremented by one at step S32, and the animation display interrupt process is finished so that the control sequence returns to the main routine shown in FIG. 6. If it is determined that the counter value N is the maximum value FFFF(H) at step S30, the counter value N is reset to zero at step S31, and is incremented by one at step S32.

Figure 6:
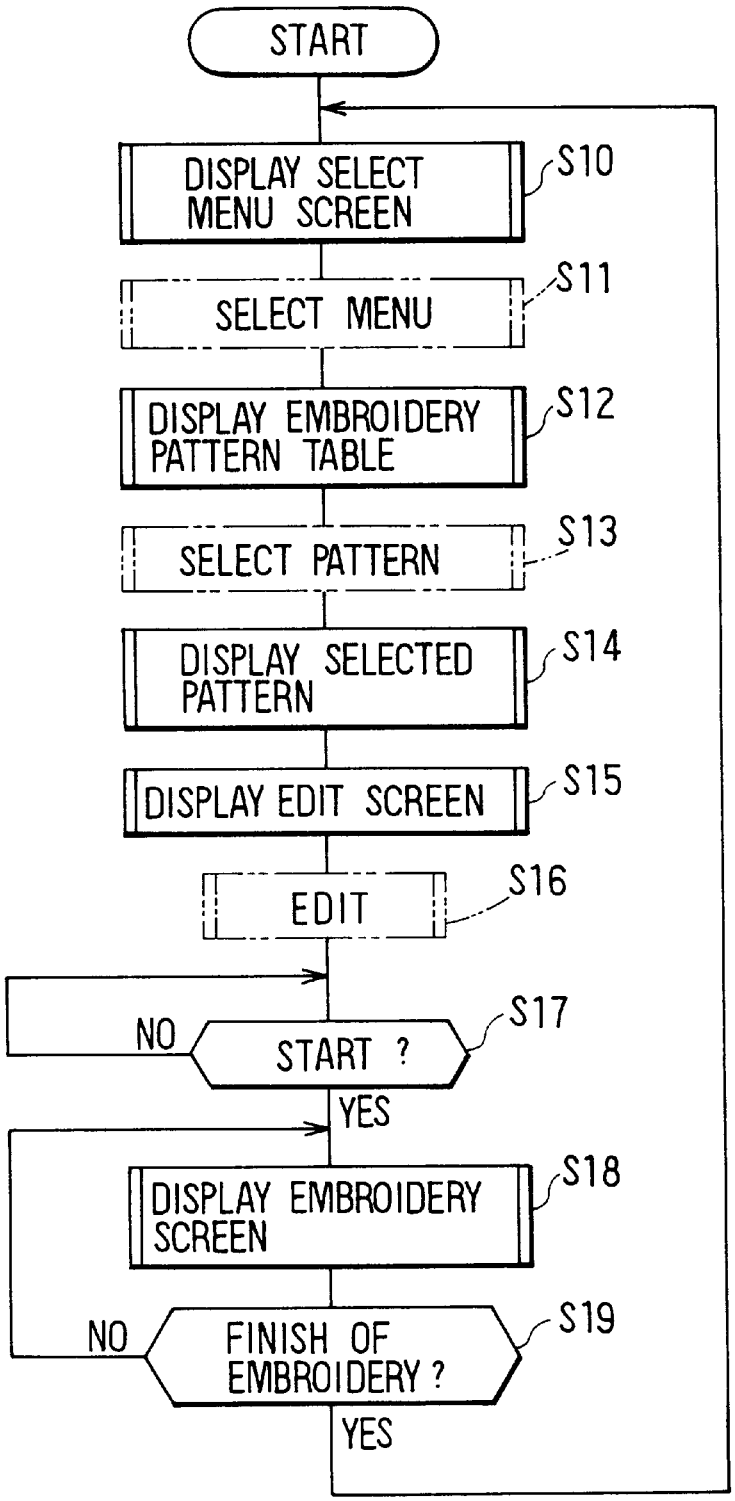
FIG. 6 is a flow chart showing a routine for information display control according to the embodiment.
Figure 7:
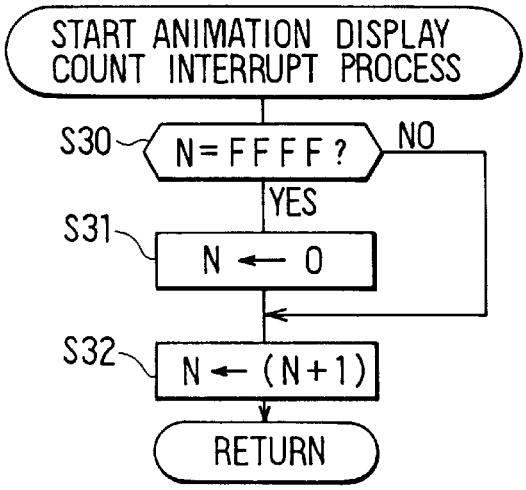
FIG. 7 is a flow chart showing a routine for animation display count interrupt processing according to the embodiment.
Figure 8:
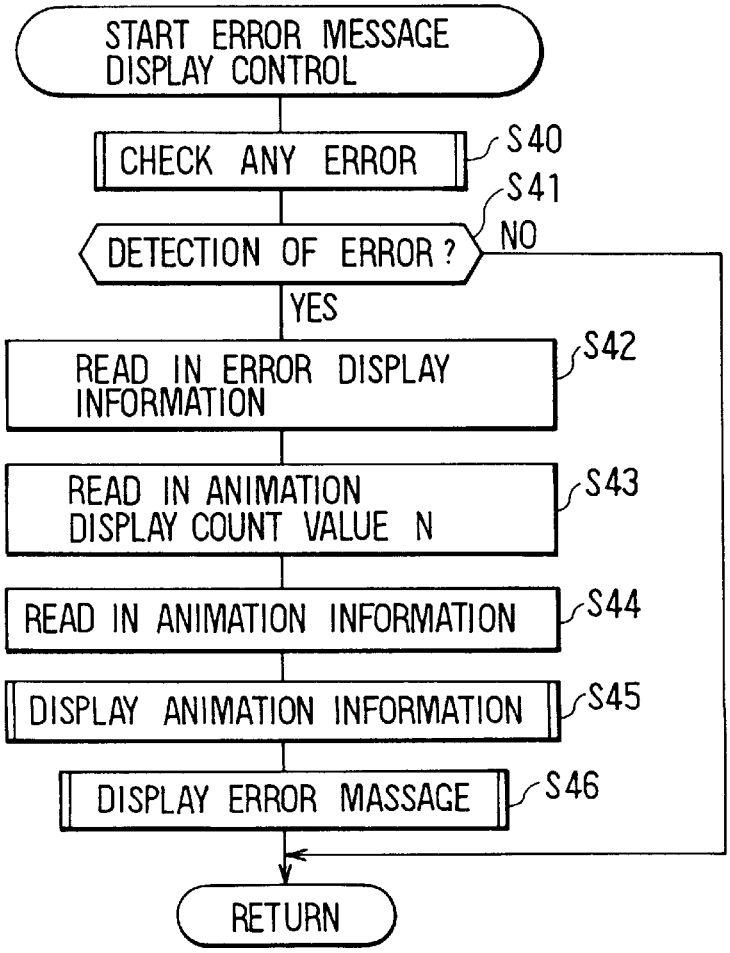
FIG. 8 is a flow chart showing a routine for error message display control according to the embodiment.

The error message display control shown in FIG. 8 is performed by an interrupt process whenever any touch key 11 or the start/stop key 12 is pressed at the information display control steps S10, S12, S14, S15 or S18 shown in FIG. 6.

The control unit C is also provided with various sensors (not shown in FIG. 2) such as a switching lever position sensor for detecting a position of a switching lever for a buttonhole hemstitch, a side cutter attachment sensor for detecting an attachment condition of a side cutter or a needle thread breakage sensor for detecting a breakage of a needle thread. Therefore, the control unit C detects various errors and malfunctions occurring during operation of the sewing machine, or in the beginning of or during sewing like buttonhole hemstitch sewing. The number of possible errors and malfunctions may be ten, for example.

When the error message display control is started, it is detected whether or not any error occurs by operating the touch keys 11 or switches at step S40. When it is determined that no error is detected at step S41, the error message display control is finished and the control sequence returns to the main routine. When it is determined that any error is detected at step S41, the control unit C reads in an error display information of the detected error at step S42. Further, the control unit C reads in the counter value N "ABCD" of the two-byte animation display counter at step S43, and then reads in the animation information AA, AB or AC from the message memory 24*c* according to the least significant bit (LSB) "D" of the counter value N "ABCD" at step S44. That is, when the bit "D" of the counter value N "ABCD" is either one of 0–5, the control unit C reads in the animation information AA. When the bit "D" is either one of 6-A, the control unit C reads in the animation information AB. When the bit "D" is either one of B–F, the control unit C reads in the animation information AC.

Figure 11:
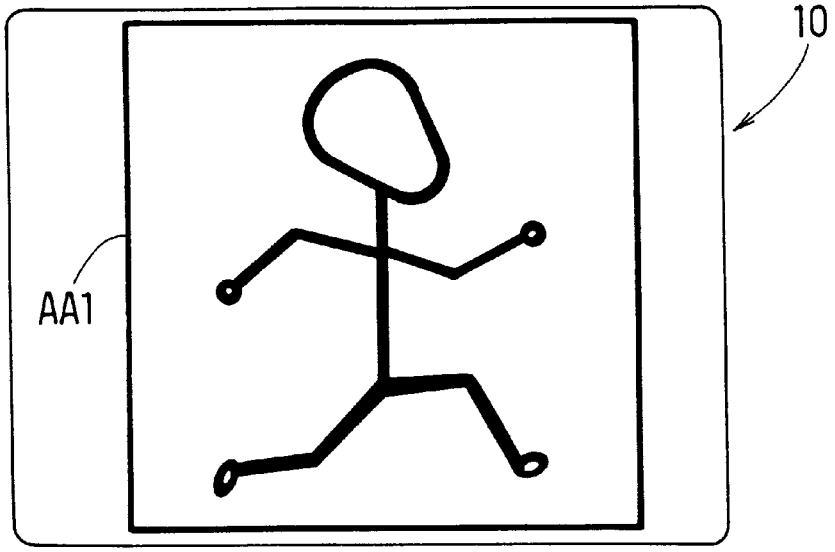
FIG. 11 is a schematic view showing a first frame of the animation information representing a human being displayed on the EDIT screen according to the embodiment.
Figure 12:
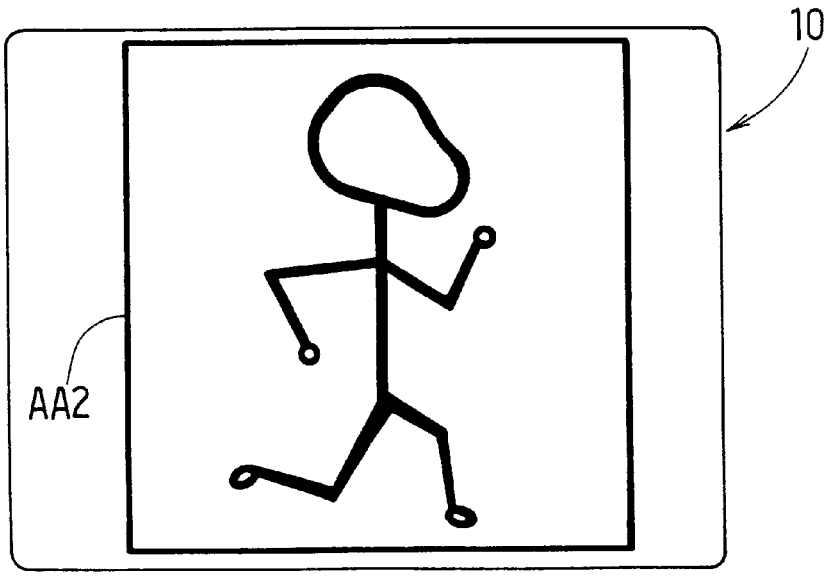
FIG. 12 is a schematic view showing a second frame of the animation information representing a human being displayed on the EDIT screen according to the embodiment.

Next, the animation information which the control unit C has read in is presented on the display 10 at step S45. For example, as shown in FIG. 10, when the upwardly-moving function key is pressed even though the embroidery pattern representing an elephant can not be moved upwardly any more with respect to the embroidery area E during the EDIT screen is displayed, an error is detected. When the animation information AA, for example, is read in according to the bit "D", the first frame AA1 of the animation information AA appears on the display 10 for a short time, as shown in FIG. 11, and then the second frame AA2 appears on the display 10 for a short time, as shown in FIG. 12. The third and fourth frames AA3, AA4 also appear on the display 10 for a short time one by one, following the second frame AA2. Therefore, an animation of a running human being is presented on the display 10. This animation attracts the operator even when the operator sees the display 10 with less attention.

Figure 13:
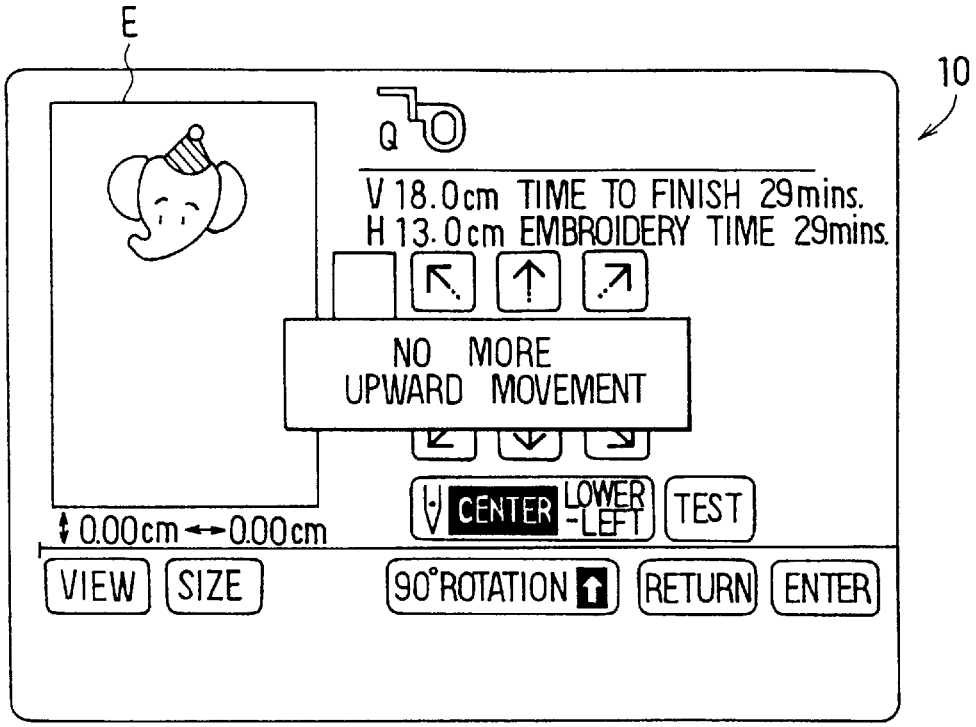
FIG. 13 is a schematic view showing an EDIT screen on the display with an error message appearing according to the embodiment.

After the animation is presented, the error message of the detected error appears on the display 10 at step S46, and the error message display control comes to an end so that the control sequence returns to the main routine. For example, as shown in FIG. 13, an error message "NO MORE UPWARD MOVEMENT" appears in the middle part of the display 10. Because the operator has already been attracted to the display 10 owing to the animation display, the operator will not miss the important error message.

Figure 9:
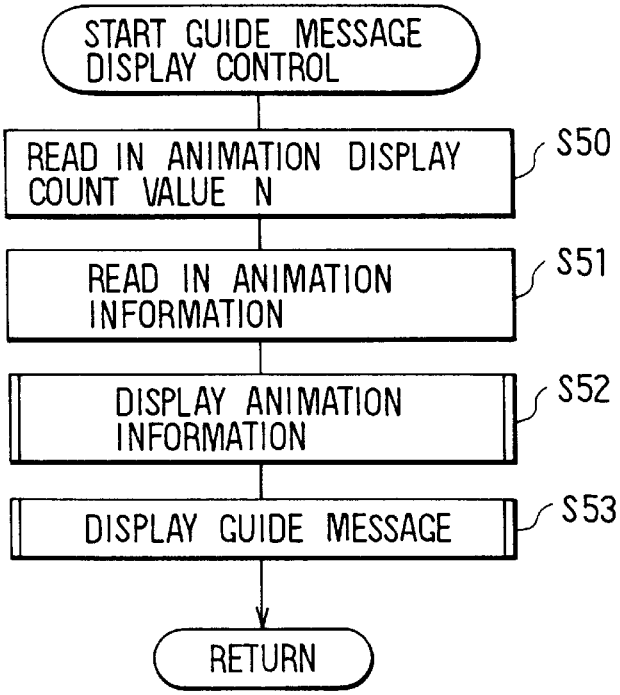
FIG. 9 is a flow chart showing a routine for guide message display control according to the embodiment.

The guide message display control is executed as shown in FIG. 9 for displaying guide messages regarding usage of the sewing machine, various stitches and so on.

When the guide message display control starts to display various guide messages, the counter value N of the animation display counter is read in the control unit C at step S50. Next, the control unit C reads in the animation information AA, AB or AC from the message memory 24*c* of the ROM 24 according to the bit "D" of the counter value N "ABCD". The animation information AA, AB or AC read in the control unit C is presented on the display 10 at step S52. When the guide message appears on the display 10 at step S53 following the animation display, the guide message display control comes to an end and the control sequence returns to the main routine.

The guide message display control, operates similarly to the error message display control, such that the guide message appears on the display 10, the operator has already been attracted to the display 10 due to an animation information representing a character on the display 10. Therefore, the operator will read the important guide message without fail.

According to the above embodiment, the electronically controlled embroidery sewing machine M has the liquid crystal display 10 in addition to the needle bar rocking mechanism, a thread take-up lever driving mechanism, the needle thread catcher and so on. Each of the three-kind animation informations AA, AB, AC is stored in the message memory 24*c*, and is read in the control unit C to be presented on the display 10 when the error/guide message is displayed, according to the error/guide message display control. Therefore, even when the operator sees the display 10 with less attention, the operator will be attracted to the display 10 due to the animation information presented on the display 10. Thus, the operator will not miss the important error/guide message, which appears on the display 10 following the animation information.

Further, in the above embodiment, the animation information appears on the display 10 before the message is displayed. Therefore, the animation information is not required to be long one to attract the operator to the display, resulting in reduction in the animation information volume to be stored, and in simplification of the error/guide message display control.

Furthermore, the number of the kinds of the animation information to be stored is three; therefore, the animation information volume to be stored is small, resulting in a lower production cost.

Further, the message memory 24*c* stores three kinds of animation information AA, AB, AC, and either one of AA, AB or AC is randomly selected to be presented on the display 10 according to the counter value N of the animation display counter every time the error/guide message is displayed. Therefore, the operator can not expect which of the animation information AA, AB or AC will be presented on the display 10 next, and can enjoy the presented animation information each time.

Figure 14:
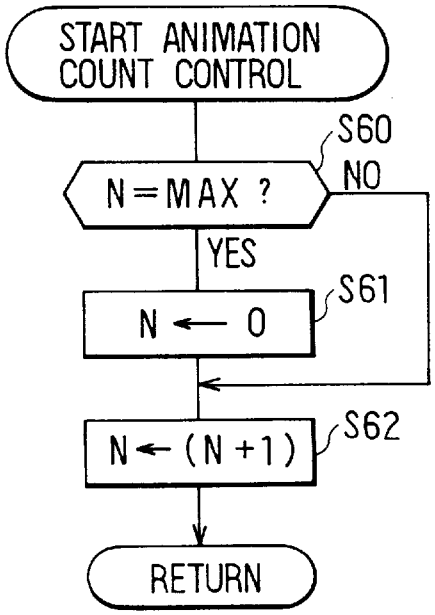
FIG. 14 is a flow chart showing a routine for animation display count control according to a modification of the embodiment of the present invention.

Further, as shown in FIG. 14, the animation display count control may be partially modified so that each of the three kinds of animation information AA, AB, AC is presented on the display 10 in the order of AA-AB-AC, which is the same order as they are stored, every time the error/guide message appears on the display 10. That is, when it is determined that the counter value N is not the maximum value at step S60, the counter value N is incremented by one at step S62, and either one of the animation informations AA, AB or AC is read in the control unit C according to the counter value N, at the error message display control step S44 or the guide message display control step S51. When it is determined that the counter value N is the maximum value at step S60, an initial value 0 is set to the counter value N at step S61. Thus, each of the three kinds of animation information AA, AB, AC is presented on the screen 10 in the order of AA-AB-AC before the error/guide message appears, resulting in that the operator can expect the next animation character appearing on the display 10 every time the error/guide message is displayed.

Furthermore, more than three kinds of animation information may be stored in the message memory 24*c* so that the animation information characters to be displayed when the error message appears are different from the animation information characters to be displayed when the guide message appears. The number of frames of the animation information may be increased to 5–10. The animation information display may be made to blink by changing of brightness of the animation information display background at a short time interval. Further, the animation information and the error/guide messages may be displayed simultaneously. The number of the kinds of the animation informations may be more or less than the number of the kinds of the error/guide messages. The present invention may be applied to various sewing machines having a display such as an ordinary sewing machine or a locking sewing machine.

Although the present invention has been fully described in connection with preferred embodiments thereof with reference to the accompanying drawings, it is to be noted that various changes and modifications will become apparent to those skilled in the art. Such changes and modifications are to be understood as being within the scope of the present invention as defined by the appended claims.

What is claimed is:

1. A sewing machine, comprising:

a sewing unit including a needle and a needle thread catcher for stitching in cooperation with said needle;

a display unit for displaying messages;

an animation information storing unit for storing a set of animation information to be displayed by said display unit, said animation information being a series of animated pictures in a plurality of frames that constitute different configurations depicting different states of a display object; and a message display control unit for displaying said set of animation information sent from said animation information storing unit on said display unit whenever one of said messages is displayed on said display.

2. A sewing machine according to claim 1, wherein said message display control unit causes said display unit to display said set of animation information sent from said animation information storing unit before said one of said messages is displayed.

3. A sewing machine according to claim 1, wherein said animation information storing unit stores a plurality of sets of different animation information.

4. A sewing machinc according to claim 3, further comprising:

a display animation information selecting unit for selecting one of said plurality of sets of animation information in a preset order to be displayed on said display unit whenever said one of said messages is displayed on said display unit.

5. A sewing machine according to claim 3, further comprising:

a display animation information selecting unit for selecting one of said plurality of sets of animation information randomly to be displayed on said display unit whenever said one of said messages is displayed.

6. A sewing machine according to claim 3, further comprising:

a counter for changing its count each time a predetermined time interval elapses; and a display animation information selecting unit for selecting one of said plurality of sets of animation information in correspondence with said count of said counter.

7. A sewing machine according to claim 3, further comprising:

a counter for changing its count at every display of said one of said messages by said display unit; and a display animation information selecting unit for selecting one of said plurality of sets of animation information in correspondence with said count of said counter.

8. A sewing machine according to claim 3, wherein the number of sets of animation information is less than the number of said messages to be displayed.

9. A sewing machine according to claim 1, wherein said one of said messages is related to erroneous operation of said sewing unit.

10. A sewing machine according to claim 1, wherein said animation information includes a series of animated pictures of a character.

11. A message display control method for a sewing machine having a display unit, comprising the steps of:

changing a count of a counter at every occurrence of a predetermined event;

determining a timing of displaying one of messages to be displayed on said display unit;

selecting a set of animation information among plural sets different from each other from a memory device, said set of animation information being selected in correspondence with said count of said counter; and displaying said selected set of animation information by said display unit at said determined timing of displaying said one of messages.

12. A message display control method according to claim 11, wherein said count is changed at every elapse of a predetermined time as said event.

13. A message display control method according to claim 11, wherein said count is changed at every display of said one of messages as said event.

14. A message display control method according to claim 11, wherein the number of said plural sets of animation information is less than the number of said messages.

15. A message display control method according to claim 11, wherein said selected set of animation information is displayed first followed by said one of messages.

16. A message display control method according to claim 11, wherein each of said plural sets of animation information comprises a fixed number of animation information frames.

* * * * *